US006244151B1

(12) United States Patent
Machamer et al.

(10) Patent No.: US 6,244,151 B1
(45) Date of Patent: Jun. 12, 2001

(54) APPARATUS FOR ADJUSTING CUTTING BAR

(75) Inventors: David Machamer, Wauconda; David J. Steidinger, Barrington, both of IL (US)

(73) Assignee: Tamarack Products Inc., Wauconda, IL (US)

( * ) Notice: Subject to any disclaimer, the term of this patent is extended or adjusted under 35 U.S.C. 154(b) by 0 days.

(21) Appl. No.: 09/326,915

(22) Filed: Jun. 7, 1999

Related U.S. Application Data

(60) Provisional application No. 60/088,913, filed on Jun. 11, 1998.

(51) Int. Cl.[7] ..... B26D 1/62

(52) U.S. Cl. ..... 83/698.51; 83/699.51; 83/663

(58) Field of Search ..... 83/698.61, 698.51, 83/698.41, 699.51, 699.61, 677, 663, 344, 345

(56) References Cited

U.S. PATENT DOCUMENTS

| | | | | |
|---|---|---|---|---|
| 4,485,710 | * | 12/1984 | Schlisio et al. | 83/346 |
| 4,920,843 | | 5/1990 | Strömberg et al. | 83/343 |
| 5,086,683 | | 2/1992 | Steidinger | 83/674 |
| 5,159,868 | * | 11/1992 | Thomas et al. | 83/674 |
| 5,211,096 | | 5/1993 | Steidinger | 83/674 |
| 5,224,408 | | 7/1993 | Steidinger | 83/674 |
| 5,282,409 | * | 2/1994 | Rojas | 83/698 |
| 5,367,936 | * | 11/1994 | Held et al. | 83/698.61 |
| 5,465,641 | * | 11/1995 | Herd | 83/698.61 |
| 5,890,410 | * | 4/1999 | Hinojosa | 83/698.41 |
| 5,904,086 | * | 5/1999 | Figge et al. | 83/698.61 |
| 5,950,516 | * | 9/1999 | Stab | 83/698.51 |
| 5,983,764 | * | 11/1999 | Hillebrand | 83/305 |

FOREIGN PATENT DOCUMENTS

| | | | |
|---|---|---|---|
| 0552396 | 6/1996 | (EP) | B26D/7/26 |

OTHER PUBLICATIONS

Tamarack Corporation "Quick Change Bar" brochure, Apr. 1995.
Meaden/Sisprint "Quick Change Perf Bar" brochure.
Meaden "Quick Change Perf Bar Mechanical Style" brochure.
EMT brochure.
GP–Tinter GP–RL 100 brochure.
Meaden brochure.

* cited by examiner

*Primary Examiner*—Douglas D. Watts
*Assistant Examiner*—Kim Ngoc Tran
(74) *Attorney, Agent, or Firm*—Emrich & Dithmar

(57) ABSTRACT

An improved adjusting apparatus for a cutting bar received in an axial slot of a blade cylinder for cutting web material. The improvement enables an operator to adjust the tilt of the cutting bar relative to the axis of rotation of the blade cylinder to accommodate out-of-parallel conditions in the blade cylinder or mounting slot so that the cutting edge of the blade held by the cutting bar is parallel to the surface of an adjacent anvil cylinder, which supports the web being cut.

23 Claims, 10 Drawing Sheets

PRIOR ART BAR

PRIOR ART BAR

PRIOR ART BAR

APPARATUS FOR ADJUSTING CUTTING BAR

RELATED APPLICATION

This application claims the benefit of the filing date of copending U.S. Provisional Application No. 60/088,913, filed Jun. 11, 1998.

FIELD OF THE INVENTION

The present invention relates to machines for processing webs or other sheet material in the paper, label and business forms industries. In particular, it relates to an improved cutting bar in such machines.

BACKGROUND AND SUMMARY OF THE INVENTION

In the paper and label processing industry, webs or sheets of material are transversely cut or perforated by relatively thin, flat blades. These blades are often mounted in a slot of a cutter or blade cylinder and clamped in the slot with a blade holding bar, also referred to as a blade bar. The blade cylinder is rotated and typically cooperates with a rotating hardened anvil cylinder or a fixed knife to effect the cut "on the fly" as the web moves, either supported by the anvil cylinder or moved over the fixed knife.

For many years, the blade was removably secured in a slot in the blade cylinder by threaded fasteners. As a result, it took approximately six minutes to change a worn blade and, further, a relatively high degree of operator skill was required to set properly the operating blade height and to clamp the blade. These delays are costly since a production line is shut down for the blade change.

Since the 1980s, companies have offered blade clamping bars with a significantly faster blade change interval; however, these bars still require considerable care and skill from the operator. Subsequent improvements disclosed in U.S. Pat. Nos. 5,086,683, 5,211,096, and 5,224,408 include a holding bar which allow a blade change in approximately six seconds and offer simple and automatic clamping as well as convenient adjustment of the height of the blade over small increments. The height adjusting feature of this apparatus allows the blade effectively to cut a variety of materials such as glassines, polyester, paper, and release liner while maximizing blade life, reducing blade change time, simplifying height adjustment of the new blade, and making the adjustment accurate.

The height-adjusting and accuracy features are advantageously practiced by means of a two-piece slide forming a split ramp which fits into a slot in the bar having a corresponding incline or ramp. As the slide member is adjusted axially of the blade cylinder relative to the other slide member, the cooperating ramp surfaces of the two slide members raise or lower the bar and, because the blade is carried by the bar, the blade is raised or lowered, as well.

The height-adjusting just described does not permit adjustment of the tilt of the blade. If the bottom surface of the slot in which the bar is installed is not parallel to the cutting surface of the anvil cylinder, for example, the blade supporting ledge of the bar and, hence, the cutting edge of the blade are not parallel to the surface of the adjacent anvil cylinder. The result is that the blade does not cut evenly across the web or sheet. The bottom of the slot may have some amount of non-parallel condition due to errors in machining the slot. Other sources of this non-parallel condition are small, but inevitable, errors in machining bearing blocks and bearing bores, and errors in aligning the side frames which typically support cutting cylinders. Until the advent of the height-adjusting bar, the parallel condition of the bottom of the slot was of minimal importance and was often not specified precisely.

In the past, the non-parallel slot condition was addressed by installing layered shim material under the bar. Layers of the shim material are peeled back and trimmed to provide an approximation of the non-parallel condition; and the shim is installed between the bar and the bottom surface of the slot to compensate for the out-of-parallel error, regardless of its cause. This compensation is effective, but it requires a relatively skilled technician to estimate the amount of non-parallel error and to configure and place the layered shim properly. Sometimes, even a skilled operator must make and try several different shims before the non-parallel condition is corrected. Moreover, the bar needs to be removed from the slot to insert the shim, and this consumes additional time. The layered shim does not provide the ideal condition of continuous support under the bar because the trimmed ends of each shim layer are slightly stepped and present a small discontinuity in support. Hence, the shim material tends to wear or 'pound out' during use, and it requires replacement.

Prior blade support bars are typically 18" to 22" wide and have a single, continuous ramp which provides the desired range of blade height adjustment (typically±0.015"). They also provide the desired range of height adjustment affected by a given amount of rotation of the adjusting tool. As bars are made wider to accommodate wider webs, however, a full-width, continuous slide is too tall at one end if it is to provide the necessary range of height adjustment. This results in one end of the slide protruding above the top of the bar. Or, on the other hand, if the slide tapers to zero at the other end, it would not be able to provide the necessary support under that end of the bar during the impact conditions of use.

To increase the width of cutter (or "blade") cylinders which the cutter bar can accommodate, a two-piece ramped slide assembly has been used with a multiplicity of shortened ramp sections. That is, each ramp section is identical, having the same incline and height range; and the ramp sections are placed side-byside to form the complete ramp. This sectional slide arrangement fits different bar widths, especially wider bars, without varying the incline angle of the ramp, thus preserving the desired range of height adjustment and the desired increment of adjustment per unit of rotation of the adjusting tool. The sectional ramp slide is a two piece assembly with precisely graded and matching ramp surfaces to provide nearly continuous support of the bar.

In the instant invention, a two-piece sliding adjustment bar with sectional ramps is used to effect height adjustment of the blade. In the preferred embodiment, the top of the upper slide is formed into a circular arc or curve having a large radius so that the total curvature over the width of the bar is small. A precisely matching circular arc is formed in the surface of the bar engaged by the upper slide member. An adjusting mechanism is provided which permits the operator to slide the upper slide member longitudinally of the bar (i.e., axially of the cylinder). As the upper slide member is moved longitudinally relative to the bar, the curved surface of the upper slide member moves along the corresponding curved surface of the bar, thus lowering the end of the bar from which the slide member moves away and raising the end of the bar toward which the slide member is moved. This motion, in turn, tilts the blade relative to the axis of the cylinder. In other words, shifting the upper slide member relative to the bar allows the bar (and the blade) to be angled relative to the bottom of the slot (and the axis of the cylinder), and thus provides the ability to compensate for, or cancel, any undesirable non-parallel condition that may exist between the slot bottom and the cylinder axis of rotation. This allows the desired, uniform cutting action across a web or sheet.

The instant invention also includes apparatus for convenient, predictable angular adjustment (i.e., tilt) of the cutting bar, for maintaining the desired adjustment during operation, and for increasing the range of tilt adjustment.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF THE ILLUSTRATED EMBODIMENT

Figure 1:
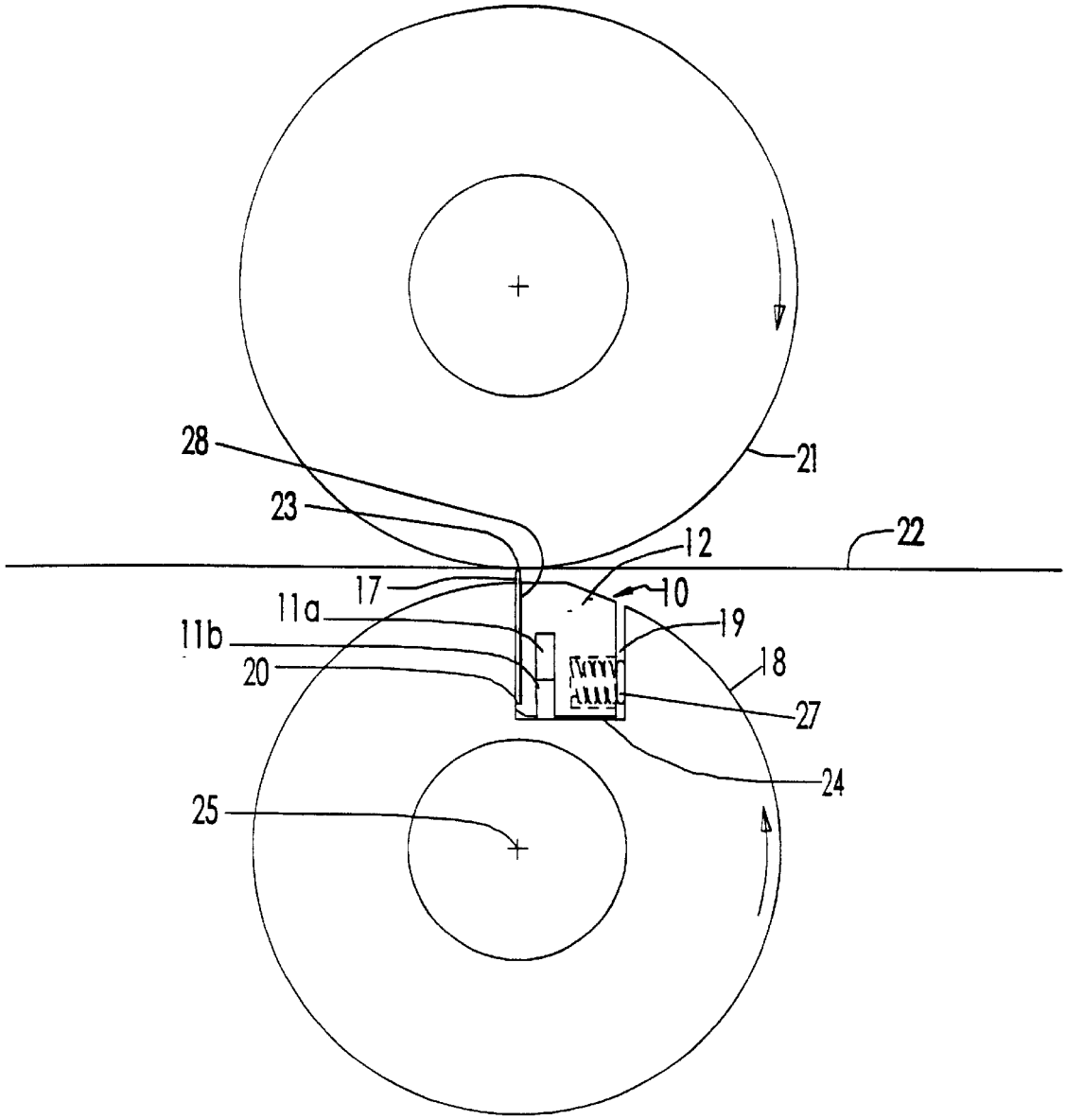
FIG. 1 is a diagrammatic end view of a blade cylinder having a replaceable cutting bar and an anvil cylinder arranged to transversely cut a web as known in the prior art.

Referring first to FIG. 1, reference numeral 10 generally designates a cutter bar assembly 10 constructed according to the prior art. The assembly 10 includes an upper slide member 11*a*, a lower slide member 11*b*, a bar 12, and springs 27. It is understood that the terms "upper", "lower", "top", "vertical", etc. are for convenience and relate to the various figures. In other words, although the bar assembly 10 rotates with blade cylinder 18 in normal use, the terms "upper", "lower", etc., are to be associated with the orientation of parts shown in the drawing.

Figure 2:
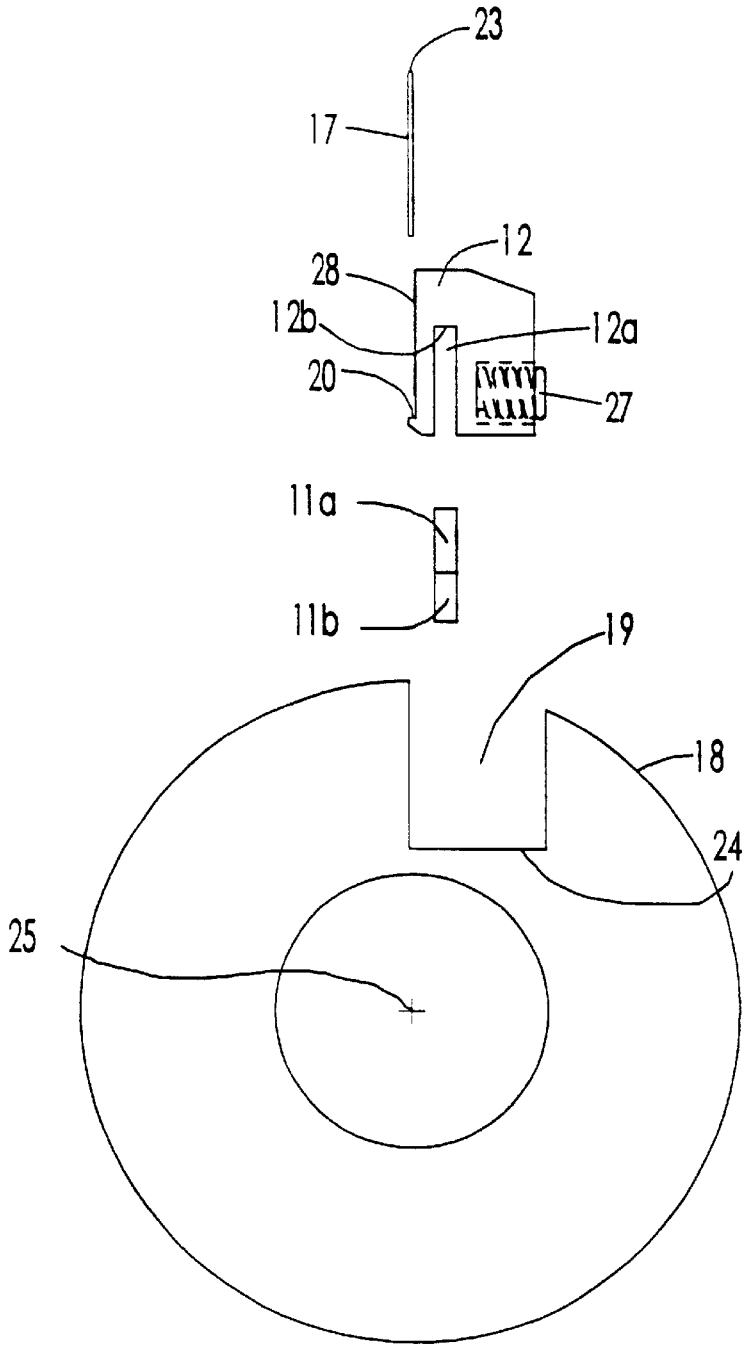
FIG. 2 is a diagrammatic end view of the blade cylinder in FIG. 1 with the parts of the replaceable cutter bar in exploded relation.
Figure 3:
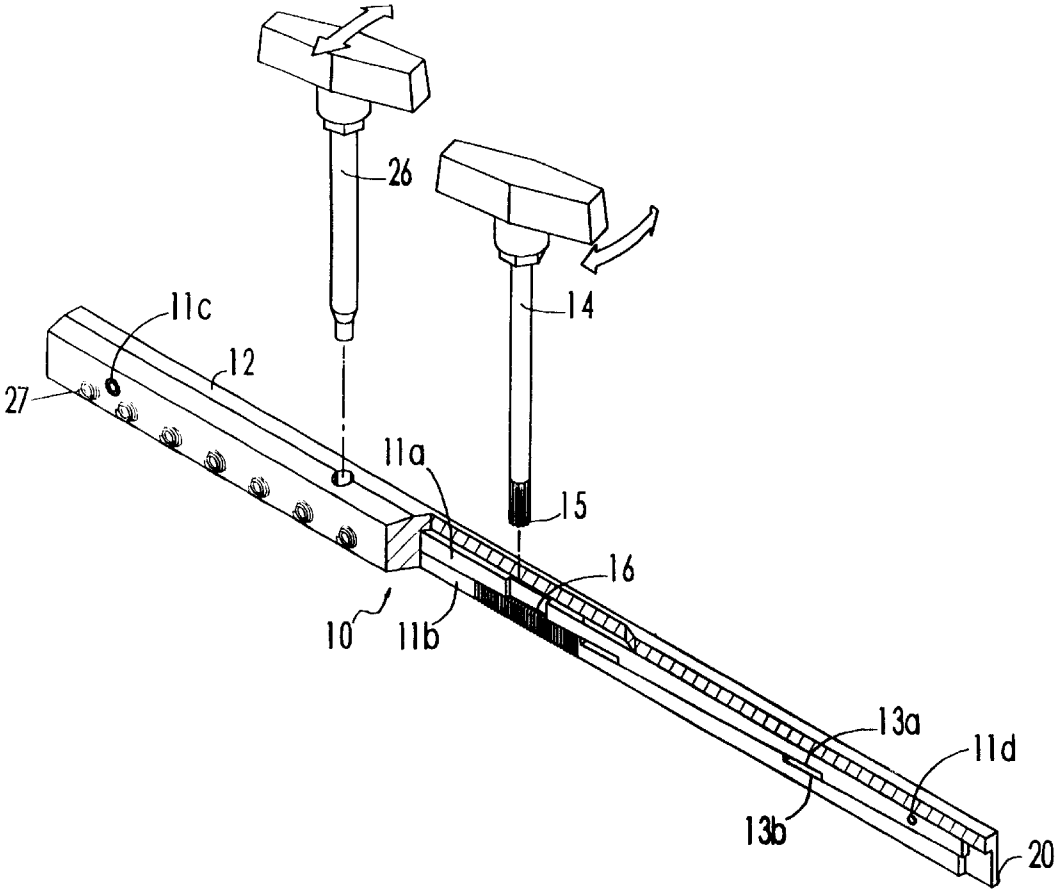
FIG. 3 is a perspective view of the cutter bar of FIG. 1 with a part of the bar in section view and showing a tool for height adjustment, and a tool for opening the bar to change blades, as used in the prior art.
Figure 4:
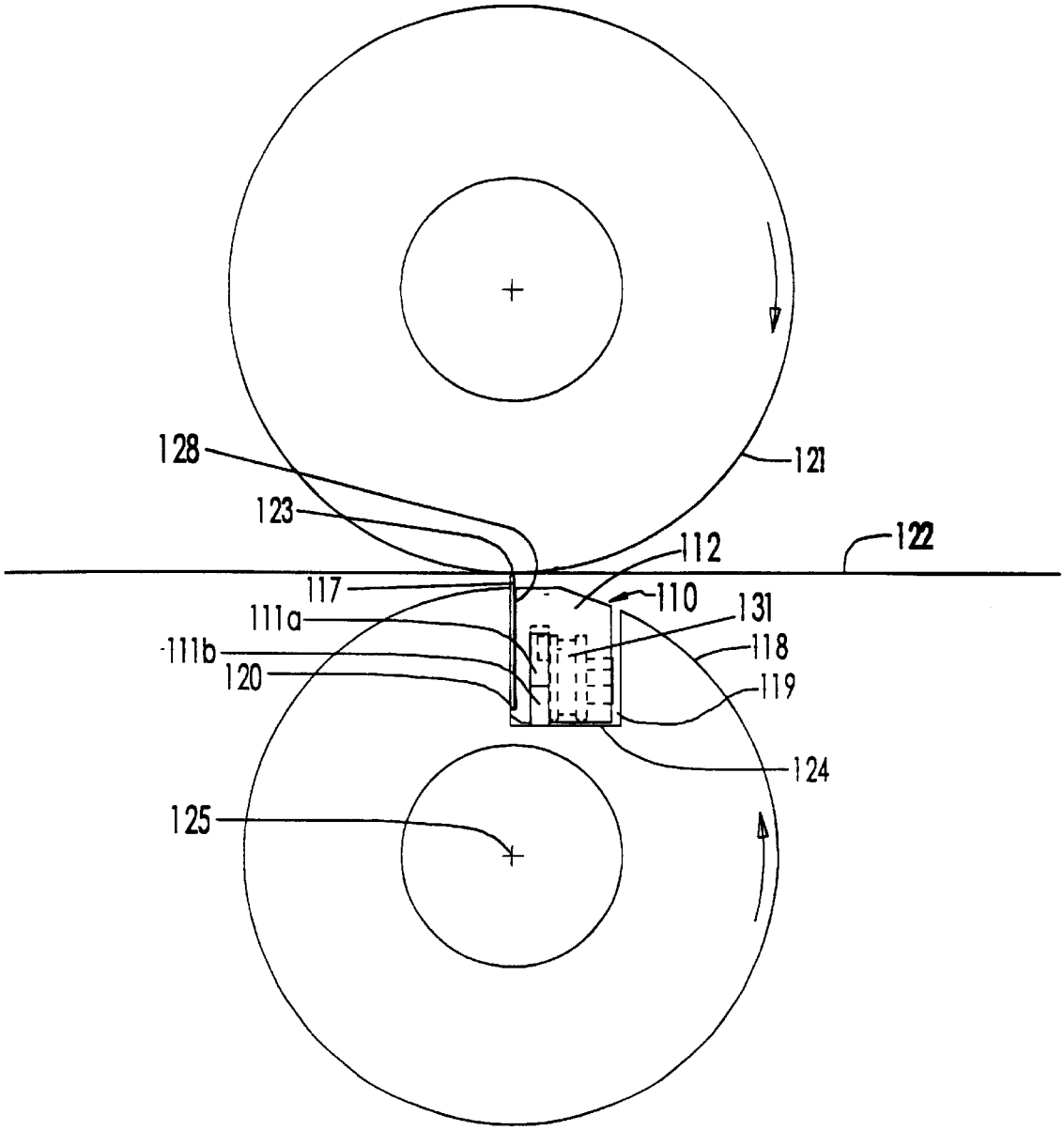
FIG. 4 is a diagrammatic end view of a blade cylinder and anvil cylinder with the cutter bar constructed and arranged according to the present invention.
Figure 5:
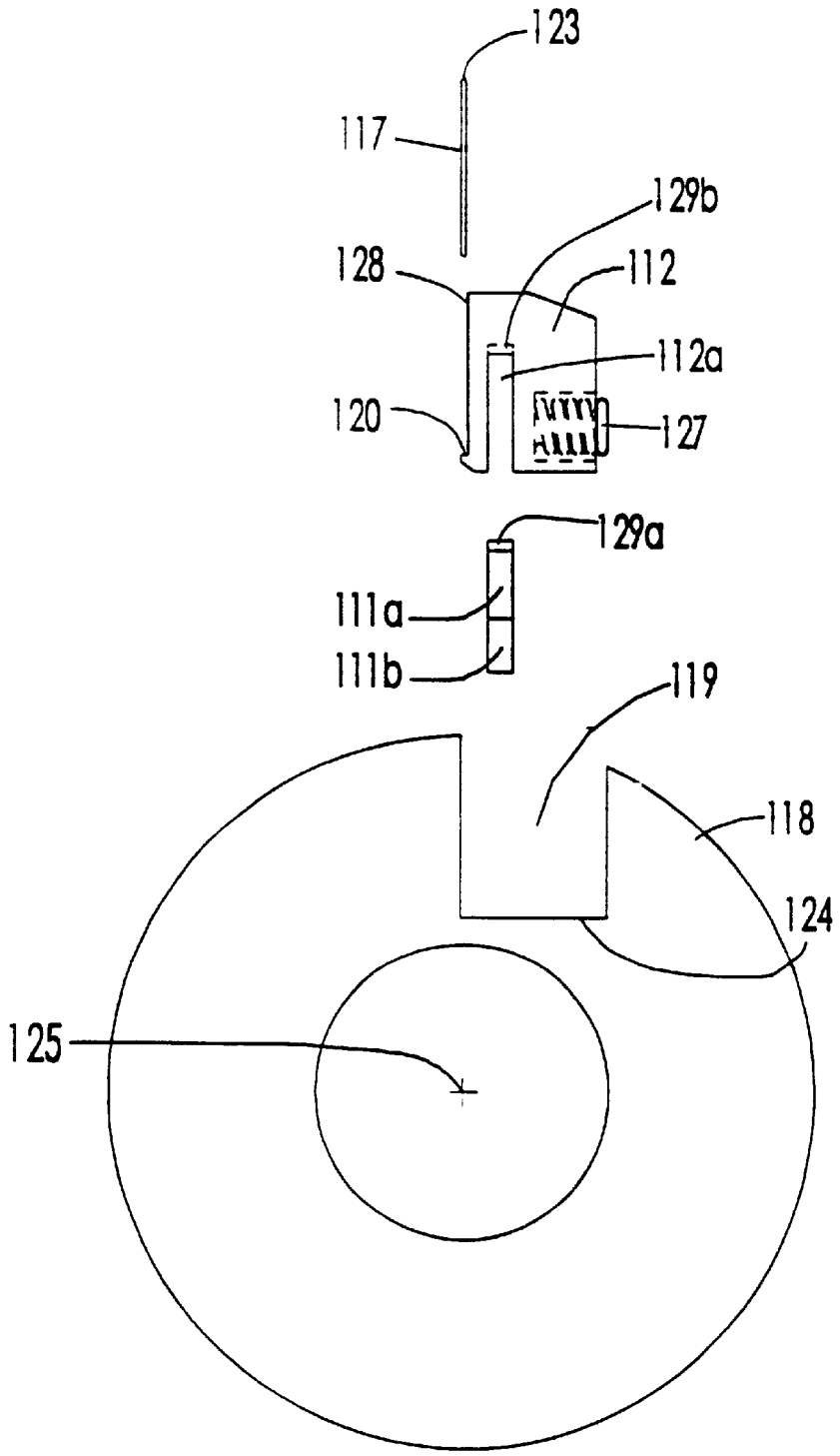
FIG. 5 is an end view of the blade cylinder of FIG. 4 with the components of the cutter bar in exploded relation.

The upper and lower slides 11*a* and 11*b*, fit closely but slidably into slot 12*a* (FIG. 2) in the bar 12. Upper slide 11*a* and lower slide 11*b* are equipped with a plurality of interengaging ramp sections arranged side-by-side. Each ramp section has a ramp surface 13*a*, 13*b* respectively (FIG. 3). The multiple ramp sections permit the bar to be manufactured in a modular slide arrangement such that longer or shorter bar assemblies may be provided by increasing or decreasing the number of ramp sections while maintaining a given vertical adjustment capability. The modular slide arrangement overcomes the difficulty of achieving the same vertical adjustment associated with the previous single ramp slide when constructing longer bars. The multiple ramp angle surfaces 13*a*, 13*b* are precisely matched to provide nearly continuous contact between the associated ramp surfaces of the upper slide 11*a* and lower slide 11*b*.

The matched ramp surfaces 13*a*, 13*b*, each surface inclined at the same angle relative to the axis of the blade cylinder 18, also provide a vertically rigid slide assembly capable of withstanding the vertical (radial) loads incurred in striking the anvil cylinder. This arrangement contributes to the strength of the bar and is beneficial in achieving consistent severing, perforating, and scoring of a web 22.

Bar assembly 10 is installed in a slot 19 in a conventional blade or blade cylinder 18. The blade 17 is supported by a ledge 20 formed on a side surface of the bar 12. The blade 17 is secured by friction between the bar surface above the ledge 20 (urged by springs 27) and the adjacent radial surface of the slot 12*a*. The blade cylinder 18 rotates in timed relation with an anvil cylinder 21 such that the blade 17 contacts and transversely severs a web or sheet 22 passing between the blade cylinder 18 and the anvil cylinder 21.

It may be desirable, depending on the application, to adjust the height of the blade not only to assure a complete cut through the web 22, but alternatively, to cut partially through the web 22. In the case of a multi-layer web 22, it may also be desired to selectively adjust the height of blade 17 to cut through one or more, but less than all layers. Height adjustment of the blade 17 is effected by inserting an adjusting tool 14 so that a pinion 15 on the tool engages a rack 16 shaped on a lower slide member 11*b*. Upper slide member 11*a* is fastened to the bar 12 and thereby restrained from lateral movement (i.e., axial of the cylinder 18). The upper slide member is secured to the bar by means of at least one screw 11*c*, but typically two screws (one at each end), which are secured in tapped holes, such as the one shown at the end of upper slide 11*a* and denoted 11*d* in FIG. 3.

Rotation of the adjusting tool 14 causes a lateral movement of the lower slide member 11*b* relative to the upper slide member 11*a* which, by means of the ramp action of the multiple ramp sections 13*a*, 13*b*, adjusts the height of the bar 12 and ledge 20 which carries the blade 17. Movement of the lower slide 11*b* to the upper left in FIG. 3 raises the blade, and movement to the lower right lowers the blade. The adjustment is very fine due to the angle of the ramp sections.

A slight 'kink' or bend (i.e. axial curvature) is purposely induced in lower slide member 11*b* so that upper slide member 11*a* fits snugly in the slot 12*a* and frictional forces exist which must be overcome to adjust the height of the bar. This bend has a vertical (i.e., radial) axis and does not affect the intimate contact between the upper surface of the upper slide 11*a* and the associated surface 12*b* at the top of slot 12*a* (FIG. 2), hence the desirable vertical rigidity of the bar assembly 10 is preserved. The prevailing frictional force prevents unintended changes in height adjustment during operation of the bar. Other methods of providing a prevailing frictional force could be employed, such as a set screw which drags against a side of the lower slide 11*b*.

In another prior art embodiment (not shown), rack 16 is part of upper slide 11*a* and lower slide 11*b* is arranged to allow vertical movement, but not lateral (i.e., axial) movement.

It can be seen that inaccuracies in the axial positions of blade cylinder 18 or anvil cylinder 21 can cause the cutting edge 23 of blade 17 to be out of parallel with the surface of anvil cylinder 21. Thus, the web 22 may not be severed, perforated, or scored uniformly or completely across its width. Incomplete severing is unacceptable, for example, in sheeting operations where each sheet must be completely severed to allow subsequent processing operations such as batching and stacking of sheets.

Similarly, if the bottom surface 24 of slot 19 is not parallel with the axis of rotation 25 of the blade cylinder 18, it is likely that the bottom 24 of the slot will also be out of parallel with the surface of the anvil cylinder 21 and again, non-uniform or incomplete severing, perforating, or scoring will result. With the prior art bar, non-parallel conditions could be corrected by the time-consuming and somewhat trial-and-error method of preparing a stepped shim made from a layered shim stock material for placement under the bar assembly 10. This process typically requires removal of the bar assembly 10 from the blade cylinder slot 19 to place the shim material on the bottom 19 of the slot, as described above.

A bar opening tool 26 is engaged with a socket in the bar to allow the bar 12 to be leveraged open against the closing springs 27 to facilitate quick replacement of blade 17.

A tungsten carbide surface 28 is flame-sprayed on one flat surface of the bar 12. This high friction, wear-resistant surface serves to resist wear and to prevent a less than full length blade from shifting laterally during cutting operations and also helps to retain blade 17 radially, to oppose centrifugal forces resulting from typical blade cylinder 18 rotational speeds.

The Inventive Bar

Figure 8:
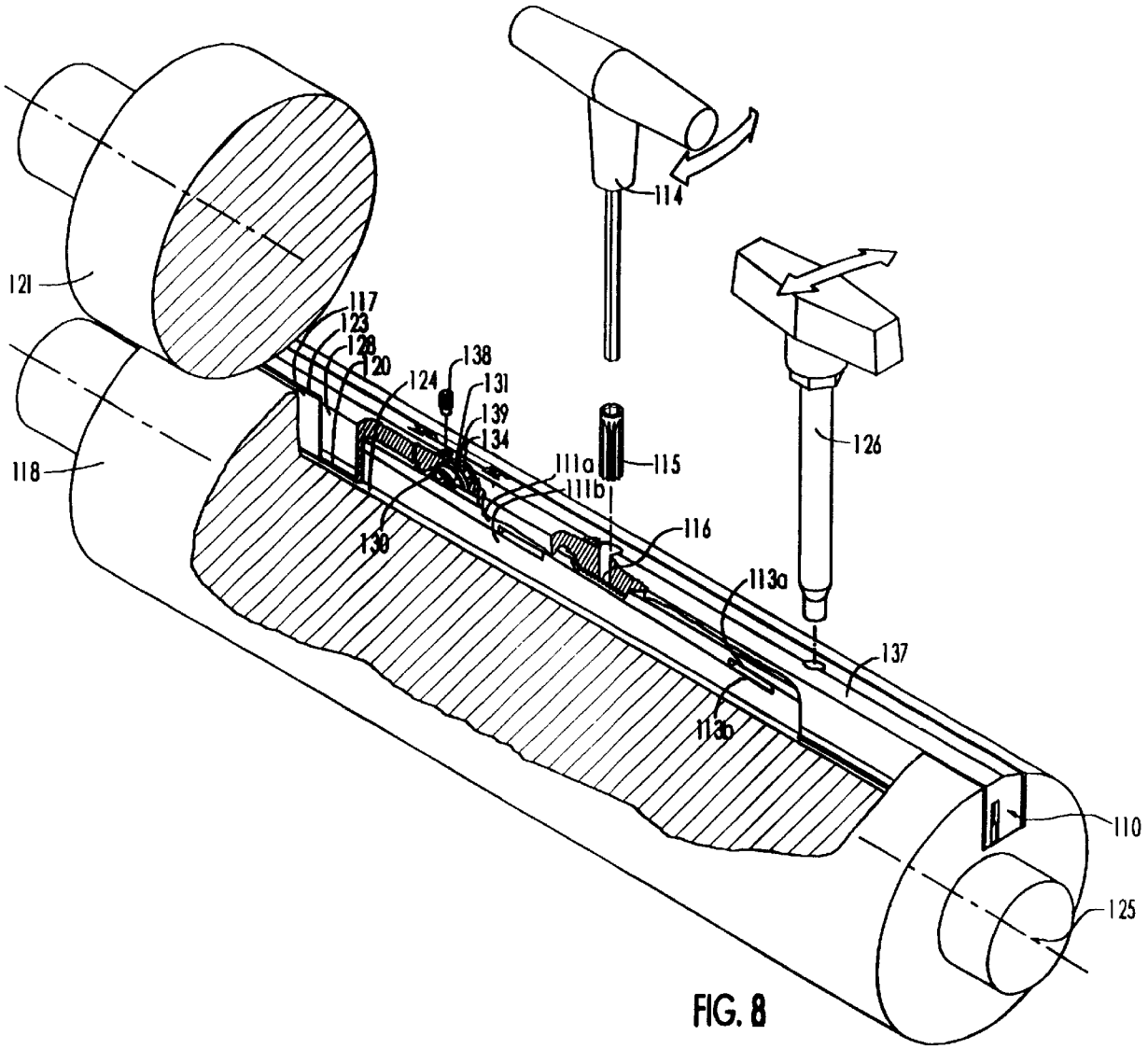
FIG. 8 is a perspective view of a blade cylinder and cutter bar and a portion of an anvil cylinder, with portions of the blade cylinder and cutter bar broken away, and with certain components in exploded relation.

The bar assembly 110 of the present invention, as will be better understood from the above description of the prior art, includes an upper slide member 111*a*, a lower slide 111*b*, a bar 112, a pinion 115 for height adjustment, springs 127, a rotatable cylinder or disc 131 for tilt or level adjustment, and a retaining/drag screw 138 (FIG. 8). Upper slide member 111*a* and lower slide member 111*b* are preferably equipped with multiple ramp sections, each section having an angled ramp surface 113*a*, 113*b*, each defining the same angle relative to the axis of rotation of the blade cylinder. Alternately, the ramp surfaces 113*a*, 113*b* could be parallel to the blade or the bottom 124 of the slot 119, similar to the prior art bar. There are significant differences in the inventive bar assembly 110, however, especially in the upper slide member 111*a* and the bar 112 which will be described. For one thing, both slide members are axially moveable relative to the bar, and to each other. The upper slide member effects tilt adjustment and it is positively secured in its adjusted position. The lower slide member effects height adjustment and is also secured in its adjusted position by friction.

Figure 6:
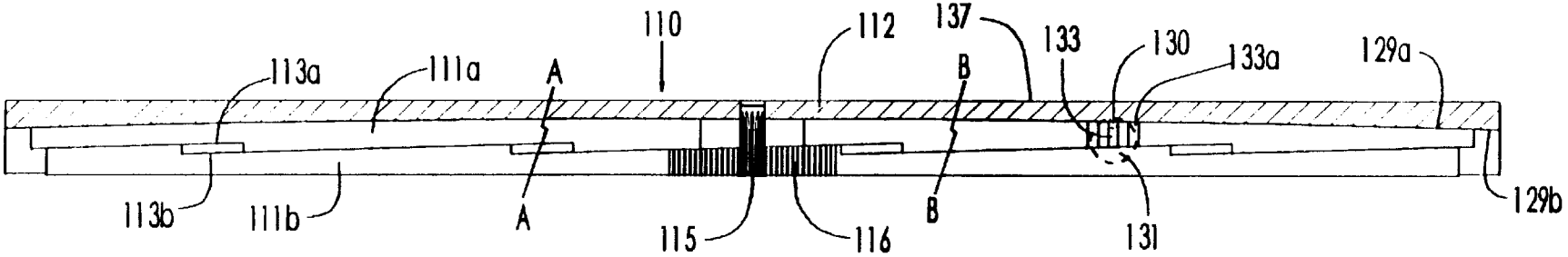
FIG. 6 is a longitudinal cross-sectional view of the cutter bar of FIG. 4 taken in a vertical plane.
Figure 7:
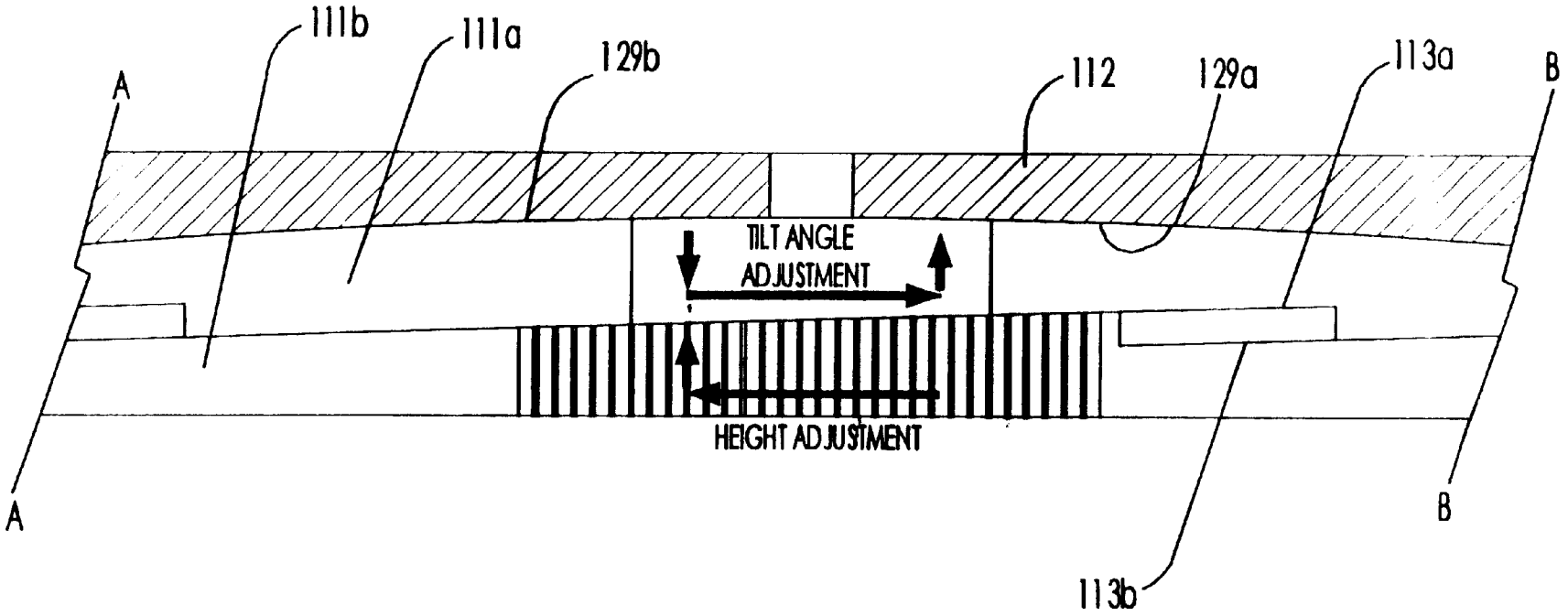
FIG. 7 is an enlarged fragmentary view of the sectioned cutter bar shown in FIG. 6 illustrating the center portion between the lines A—A and B—B of FIG. 6.

The upper surface 129*a* of the upper slide member 111*a* is formed into a uniformly curved contour (i.e., curved axially of the blade cylinder) with a large radius; in the instant invention this radius is 1296 inches (32.92 meters). That is, the center of the arc is on a vertical line in FIGS. 6 and 7 extending through the center of the upper slide member and 1296 in. from the curved surface 129*a*. The bar 112 has a matching curved contour 129*b*. The arcuate contours 129*a* and 129*b* are matched so that their engagement provides a continuous, rigid support of the slide member 111*a* in the bar 112 in all adjusted positions of height and tilt.

When the upper slide 111*a* is longitudinally centered in bar 112, the ledge 120 and bottom of lower slide 111*b* are nominally parallel and when the bar assembly 110 is installed in a typical blade cylinder 118, the ledge 120 is parallel with the bottom 124 of slot 119. One important advantage of the invention, however, is that neither parallel relation just described is essential since the present invention can compensate for a non-parallel condition in either or both relations, as will now be described. In other words, the object of the present invention is to provide means for adjusting the cutting edge of the blade so that it is parallel to the surface area of the anvil cylinder which the blade strikes.

When upper slide 111*a* is shifted to either side of the center position, the ledge 120 becomes angled or tilted relative to the bottom of slide 111*b*, and thus the bottom 124 of the slot 119. That is, shifting the upper slide member 111*a* longitudinally toward either end raises that end relative to the other end of the blade (i.e., the one away from which the slide is moved). Similarly, when the bar assembly 110 is installed in blade cylinder 118, the blade support ledge 120 is consequently angled relative to the bottom 124 of the slot 119 when the upper slide member is shifted longitudinally (i.e., axially of the blade cylinder). Since the ledge 120 supports the blade 117, the curved contours 129*a* and 129*b* provide the means for adjusting the tilt or level of the cutting edge 123 of blade 117 so that it can be parallel to the surface of adjacent anvil cylinder 121 even if the axis of rotation of blade cylinder 118 is not parallel to the axis of rotation of the anvil cylinder 121 or if the bottom 124 of the slot 119 is not machined parallel to the axis of rotation 125 of the blade cylinder 118. Both of these non-parallel conditions are common in printing, collating, and web finishing equipment, for example.

Figure 9:
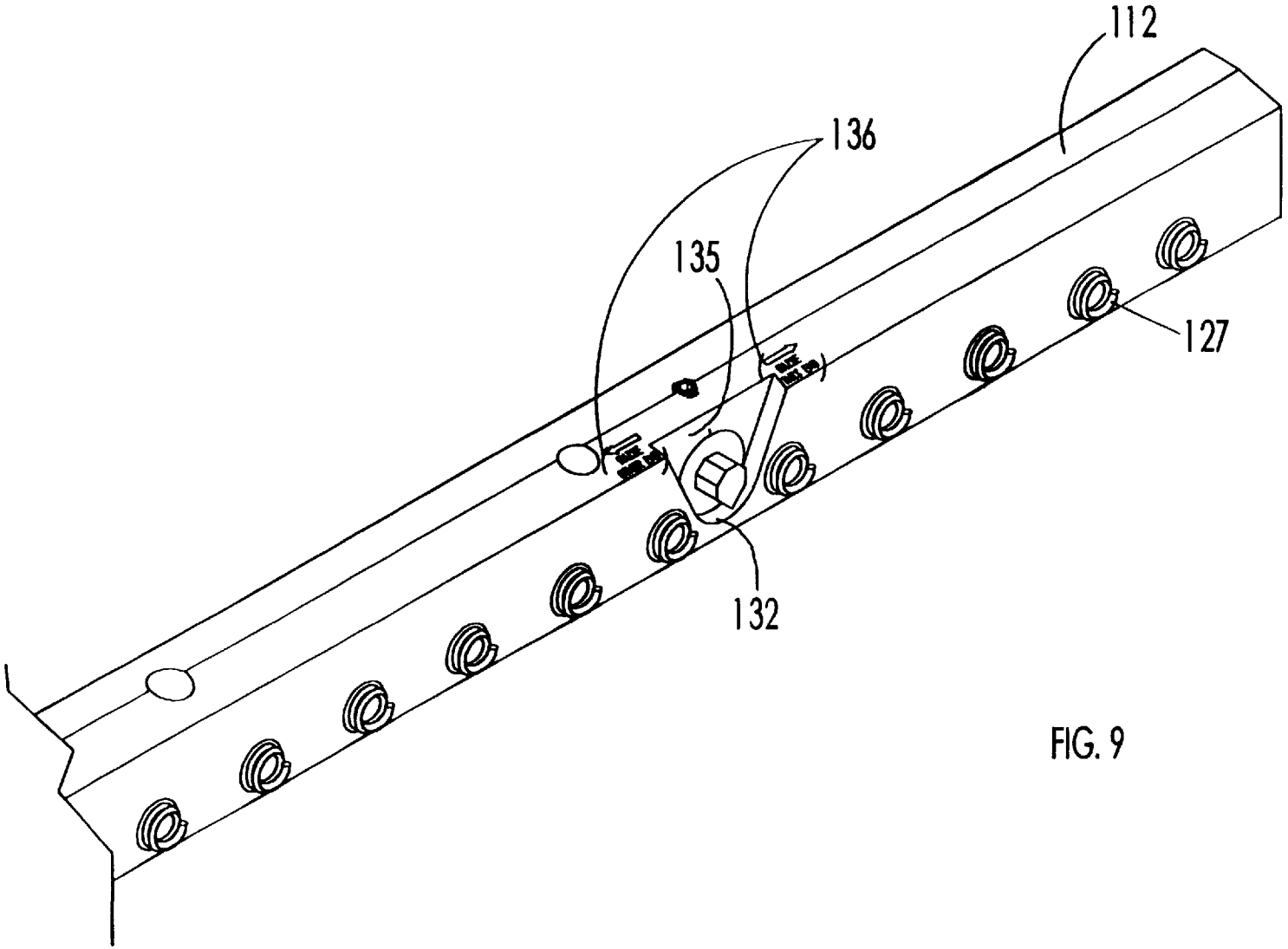
FIG. 9 is a fragmentary perspective view of the cutter bar of FIG. 4 showing the level adjusting mechanism.
Figure 10:
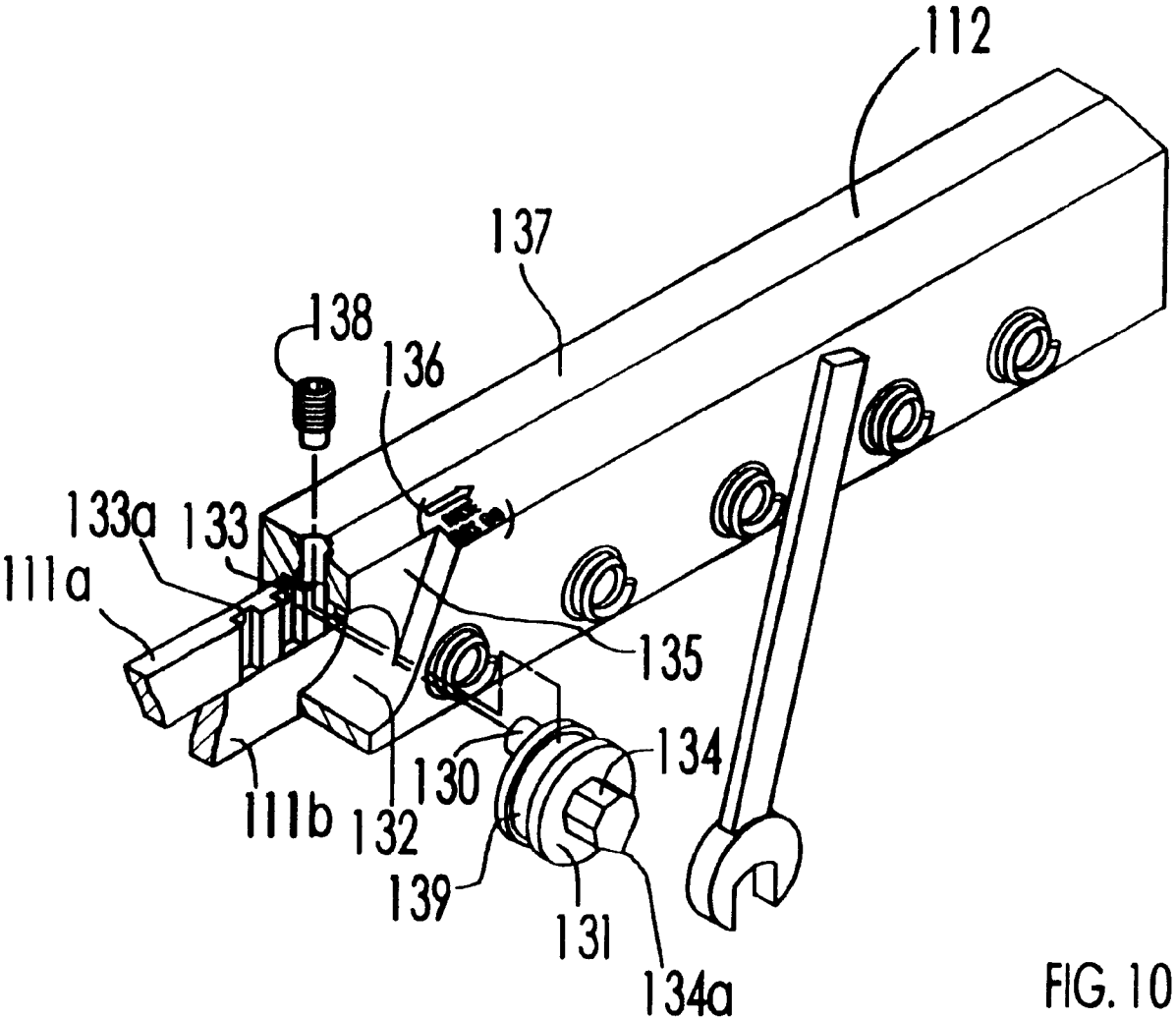
FIG. 10 is a fragmentary perspective of a portion of the cutter bar of FIG. 9, with portions of the cutter bar broken away and with components in exploded relation.

The axial position of the upper slide member 111*a* is controlled and secured by an eccentric pin 130 (FIGS. 8 and 10) on an adjusting cylinder 131 mounted for rotation in the bar 112. Eccentric pin 130 is received in a vertical (radial) groove 133 machined in the upper slide 111*a*. Rotatable cylinder 131 is supported in a cylindrical bore 132 in the clamp bar 112. The rotatable cylinder 131 is equipped with a partial octagon drive head 134 (FIG. 10) suitable for torquing with an open end wrench or similar tool. The octagonal head 134 is only partial, that is, it includes a projection 134*a* so that when seated in a generally U-shaped pocket 135 (FIGS. 9 and 10) formed in the clamp bar 112, the range of motion of the open-end wrench used for adjusting the tilt is limited by the sides of the "U" shape, and consequently the range of rotation of the adjusting cylinder 131, the longitudinal travel of the upper slide 111*a* and the range of parallel (or blade tilt) adjustment of the bar 112 and blade 117 are limited. This is considered an advantage. The limited range of rotation also assures that the cylinder 131 and its eccentric pin 130 remain in the desired quadrant or portion of groove 133 so that the direction of adjustment corresponds with a directional "Level Adjuster" instruction 136 shown on the top surface 137 of bar 112. That is, if the pin 130 is above the axis of rotation of the adjustment cylinder 130, a clockwise rotation of the cylinder will move the upper slide to the right in FIG. 10. But if the pin is below the axis of rotation, the same rotation of the cylinder will move the upper slide to the left.

By way of exemplary example, when a conventional ¼" open-end wrench is used to rotate the adjusting cylinder 131 through a range of approximately 90° with the radius of curvature of the surfaces 129*a*, 129*b* on the upper slide 111*a* and bar 112 being 1296 inches, the end of the bar 112 adjacent to the rotatable cylinder 131 is adjustable over a range of approximately 0.003 inches (for a bar 18" wide) from a nominally level condition (i.e., total adjustment range of approximately 0.006 inches).

This amount of adjustment is sufficient for normal amounts of nonparallel condition between the bottom 124 of the blade cylinder slot to the surface of anvil cylinder 121. The adjusted position of the upper slide is maintained by friction provided by a brass tip drag screw 138 which is received in a circumferential groove 139 circumscribed on the rotatable cylinder 131. The screw 138 provides a threshold friction force which prevents the cylinder 131 from rotating, and hence the level adjustment from changing, until the threshold force is overcome by the open-end wrench. The protrusion of the screw 138 into the groove 139 also serves to retain the cylinder 131 in the bar 112.

When screw 138 is removed, the rotatable cylinder 131 may be removed and the upper slide 11 a manipulated so that eccentric pin 130 may be engaged in one of the alternate grooves 133*a* located to either side of groove 133. This allows utilization of a further range of angle or tilt adjustment in the event that the center groove 133 does not allow enough angle adjustment to achieve the desired goal of setting the blade cutting edge 123 parallel to the surface of anvil cylinder 121. It may be desirable intentionally and controllably to adjust the blade cutting edge out of parallel with the surface of anvil cylinder 121 and the inventive bar will accommodate this goal as well. Other adjusting mechanisms could be substituted for the rotatable cylinder 131 and its associated features which would provide a functionally equivalent means of adjusting the position of upper slide 111*a* in bar 112. Further, the engaging surfaces 129*a*, 129*b* could be located respectively at the bottom of the lower slide member 111*b* and the bottom surface 124 of the slot 119, although it may add cost to machine the bottom of the slot to be curved.

Height adjustment of the bar assembly 110 and blade 117 is similar to the prior art bar. A gear rack 116 on the lower slide 111*b* and a pinion 115 cooperate to allow the lower slide to move laterally in bar 112 and relative to upper slide 111*a*. An adjusting wrench 114 is engaged with the hex socket equipped pinion 115. Rotating the wrench 114 and pinion 115 moves the lower slide 111*b* longitudinally via gear rack 116. The multiple ramp sections 113 thus cause the bar 112 to raise or lower a predictable amount. The lower slide member is held in the adjusted position as in the prior embodiment.

However, in the illustrated embodiment, the pinion 115 has been separated from the adjusting tool 14 and mounted in the bar, with several resulting advantages. Since adjusting tools are often mishandled and abused, the pinion 15 on the prior art adjusting tool 14 could be damaged and, in meshing with the rack 16, damage the teeth on the rack as well. The illustrated pinion 115 is secured within the bar assembly 110 so that it cannot be removed. This better protects the pinion 115 and consequently the rack 116. Also, the adjusting tool 114 has a common hex drive head at its functional end, thus if the adjusting tool 114 is lost, it may readily be replaced by a common hex key or Allen wrench.

During height adjustment, it is desirable that upper slide 111*a* remain stationary in bar 112 so that level adjustment is not disturbed and so that the height adjustment is predictable. Upper slide 111*a* is positively restrained against axial movement by the eccentric pin 130 of the rotatable cylinder 131 in the groove 133, as described above. The lower slide 111*b* has a prevailing frictional force, as described above, which prevents unintended changes in height adjustment during operation. It is anticipated that other means of moving, or advantageously restraining, upper slide 111*a* and lower slide 111*b* may be employed to provide a similar adjustment function but with other enhancements such as fine and coarse adjustment ranges by means of differential action, racks in each of the upper slide 111*a* and lower slide 111*b*, or variable pitch rack and pinion, for example.

A tungsten carbide surface 128 is flame sprayed on one flat surface of the bar, similar to the prior art bar. Also similar to the prior art bar, an opening tool 126 is used to leverage the bar open against the springs 127 to facilitate replacement of blade 117.

Again, by way of specific example, the clamping bar 112 is made of 4140 pre-hardened steel. The various contours are milled on the outer surfaces of bar 112. The slot with curved contour 129*b* is milled with a CAM (computer aided manufacturing) generated contouring program on a CNC (computer numerical control) vertical milling machine. Instructions, such as level adjustment instruction 136, specifications, and product identification are laser engraved on the top surface of the clamp bar 112. The upper and lower slides 111*a* and 111*b* are manufactured from a single, rectangular piece of pre-hardened 4140 steel.

The curve 129*a*, which has a radius of 1296 inches to match the curve 129*b* in the clamp bar 112, is generated on the upper slide by a CNC-controlled creep-feed grinder. These methods of generating matching features 129*a* and 129*b* provide the precision fit necessary for full support of the upper slide in the clamp bar and predictable angular (i.e. level) adjustment of the bar 112.

The upper and lower slides are split from a single blank having a curved top formed by creep-fed grinding. The splitting is done with a CNC-controlled wire EDM (electro-spark discharge machine). This method provides inherently matched ramp angles 113 which are desirable for full support of the mating surfaces on the upper and lower slides 111*a* and 111*b* and for consistent, predictable adjustment. Gear rack 116 is shaped on the lower slide 111*b* using a gear shaper or milling machine. The rotatable cylinder 131 is made with a CNC turning center. The turning center is equipped with 'live tooling' on the turret which forms the eccentric pin feature 130, partial octagon feature 134, and groove 139.

The pinion 115 is made of 4140 steel. The gear pinion feature is hobbed with typical gear shaping techniques. A hexagonal socket is generated by drilling a hole partially through the axis of the pinion and then plunging a hexagonal broach into the drilled hole to generate a hexagonal female socket appropriate for use with a typical hexagonal 'Allen' wrench.

While particular embodiments of the present invention have been shown and described, it will be apparent to those skilled in the art that changes and modifications may be made without departing from the invention in its broader aspects. The matter set forth in the foregoing description and accompanying drawings is offered by way of illustration only and not as a limitation.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. A support bar assembly adapted to be mounted in a bar-receiving slot of a blade cylinder rotatable about an axis, said receiving slot extending axially of said blade cylinder and partially defined by an elongated reference surface, comprising:

an elongated bar adapted to be received in said receiving slot of said blade cylinder, and including an axially elongated ledge adapted to receive a blade defining a cutting edge;

said bar supporting said blade in operative relation with said blade cylinder;

said bar further defining a first curved bearing surface extending in an axial direction and in opposing relation to said reference surface when said bar is inserted in said receiving slot;

a height-adjusting mechanism supporting said bar against said reference surface of said receiving slot when said bar is received therein, said height-adjusting mechanism including a first slide member defining a first ramp surface and a support surface engaging said reference surface of said bar-receiving slot, and a second slide member defining a second ramp surface engaging said first ramp surface, said second slide member including a curved second bearing surface engaging said first bearing surface of said bar, whereby as said second slide member is moved longitudinally, said cutting edge of said blade may be controllably adjusted relative to said axis of rotation of said blade cylinder.

2. The apparatus of claim 1 wherein said first and second slide members each define a plurality of ramp sections each including a ramp surface, said surfaces of said ramp sections of said first slide member engaging associated ramp surfaces of said ramp sections of second slide member, the angle of all of said ramp section surfaces relative to said axis of rotation of said blade cylinder being substantially equal.

3. The apparatus of claim 2 wherein said ramp sections of said first and second slide members are laterally spaced and aligned along a line parallel to said axis of rotation of said cylinder.

4. The apparatus of claim 3 wherein said first slide member includes a gear rack extending therealong in an axial direction, said bar assembly further including a pinion rotatably received in said bar assembly and engaging said rack, whereby a tool may be coupled to said pinion and turned, thereby translating said first slide member longitudinally of said bar by means of the engagement of said pinion with said rack to adjust the height of said cutting edge relative to said axis of rotation.

5. The apparatus of claim 1 further including an adjustment member mounted to said bar and engaging said second slide member for translating said second slide member axially, thereby to tilt the angle of said bar relative to said axis of rotation of said cylinder.

6. The apparatus of claim 5 wherein said adjustment member is rotatably mounted in said bar and includes a projection mounted eccentrically relative to the axis of rotation of said adjustment member, and wherein said second slide member includes a slot extending in a generally radial direction and receiving said eccentric projection, whereby as said adjustment member is rotated, said projection moves said second slide member longitudinally.

7. The apparatus of claim 6 further comprising second and third slots in said second slide member, each extending in a radial direction and spaced axially from said first-named radial slot whereby said adjustment member may be removed from said bar and said second slide member translated manually in an axial direction and said adjustment member reinserted with said projection engaging a different one of said radial slots, thereby to index said second slide member while maintaining the adjustment thereof with said adjustment member and allowing said blade to be adjusted through further ranges of adjustment.

8. The apparatus of claim 7 wherein said adjustment member includes a torquing head engagable by a tool over a limited angular displacement thereof, said bar defining a recess cooperating with said torquing head when said rotatable adjustment member is mounted in said bar, said recess constructed and arranged to limit the angular displacement of said adjustment member by said tool coupled to said torquing head, thereby to limit the longitudinal displacement of said second slide member.

9. The apparatus of claim 8 wherein said adjustment member includes a peripheral groove and said apparatus further includes a friction screw threaded in said bar and extending into said peripheral groove of said adjustment member to removably secure said adjustment member to said bar and to adjust the friction on said adjustment member.

10. An improved support bar assembly for use in a web cutting apparatus, said support bar assembly supporting a cutting blade having a cutting edge and adapted to be received in an elongated slot of a blade cylinder having an axis of rotation, said slot extending axially of said blade cylinder and partially defined by an axial reference surface, the improvement comprising: said support bar assembly including an elongated support bar defining a first bearing surface having first and second ends in axially spaced relation and having an axial curvature; and slidable height adjustment mechanism assembled with said support bar assembly having a second bearing surface engaging said first bearing surface of said support bar, said height adjustment mechanism being supported against said reference surface of said slot when said support bar assembly is operatively received therein, and further characterized in that when said height adjustment mechanism is moved in an axial direction, said first end of said first bearing surface is moved away from said reference surface and said second end of said bearing surface is moved toward said reference surface thereby to adjust the tilt of said cutting edge of said blade.

11. The apparatus of claim 10 characterized in that said second bearing surface has an axial curvature conforming to said axial curvature of said first bearing surface.

12. The apparatus of claim 10 characterized in that said first bearing surface has a concave curvature; and said second bearing surface has a convex curvature.

13. The apparatus of claim 12 further characterized in that said curvatures of said first and second bearing surfaces are portions of circular arcs having the same radius.

14. The apparatus of claim 12 wherein said curvature of said first and second bearing surfaces is characterized in that the respective portions of said first and second bearing surfaces furthest from said reference surface are located intermediate said ends of said first and second bearing surfaces.

15. The apparatus of claim 14 wherein said radius of curvature of said arcs is greater than 20 feet.

16. The apparatus of claim 10 wherein said height adjustment mechanism comprises a first slide member having at least one ramp surface inclined relative to said axis of rotation of said blade cylinder; and a second slide member having at least one ramp surface conforming to and engaging said ramp surface of said first slide member, said second slide member engaging and being supported by said reference surface of said slot when said support bar assembly is placed in operative condition in said slot.

17. The apparatus of claim 16 wherein said first and second slide members each have a plurality of ramp surfaces inclined relative to said axis of rotation and arranged end to end longitudinally of the associated slide member.

18. The apparatus of claim 10 further including a rotatable member for sliding said height adjustment mechanism axially of said bar such that said second bearing surface is translated longitudinally relative to said support bar, and said first bearing surface and said support bar are adjustably tilted relative to said axis of rotation of said blade cylinder.

19. The apparatus of claim 18 wherein said height adjustment mechanism includes a slot extending radially of said blade cylinder and said rotatable member includes an adjustment member having a circular cross section rotatably mounted in said support bar and carrying an eccentrically located pin extending into said groove, whereby as said adjustment member is rotated, said height adjusting mechanism is caused to move axially relative to said bar, thereby to move said first curved bearing surface relative to said second curved bearing surface and to adjust the level of said bar and said blade axially of said blade cylinder.

20. The apparatus of claim 19 wherein said adjustment member further includes a drive member of partial hexagonal shape and includes a projection, said bar defining a recess for said drive member of said adjustment member and cooperating therewith to prevent a complete rotation of said adjustment member thereby to limit the range of adjustment of said support bar.

21. The apparatus of claim 20 wherein said height adjustment mechanism comprises at least a second slot parallel to and spaced from said first-named slot and adapted to receive said pin of said adjustment member whereby said adjustment may extend over at least first and second ranges associated respectively with said pin of said member being received in said first and second slots respectively.

22. In combination, a blade cylinder mounted for rotation about an axis and including an elongated slot; a slidable member in said slot having an axially extending first bearing surface defining a curvature extending in an axial direction; a support bar removably mounted in said slot; and a blade defining a cutting edge carried by said support bar, said support bar having a second bearing surface engaging said first bearing surface of said slidable member when said bar is placed in said slot, said second bearing surface defining an axial curvature conforming to said curvature of said first surface, whereby as said first and second bearing surfaces are translated longitudinally relative to each other, said blade is adjusted in tilt relative to said axis of rotation.

23. An improved support bar assembly for use in a web cutting apparatus including a blade cylinder mounted for rotation about an axis and having an elongated receiving slot providing an axially extending reference surface, said support bar assembly supporting a cutting blade and adapted to be received in said receiving slot of said blade cylinder, the improvement comprising: said support bar assembly including an elongated bar, one of said bar and said receiving slot defining a first bearing surface having first and second ends in axially spaced relation and having an axial curvature; and an elongated moveable slide member defining a second bearing surface engaging said first bearing surface and having an axial curvature conforming to the curvature of said first bearing surface, said first and second bearing surfaces being constructed and arranged such that when said slide member is moved longitudinally, said elongated bar is adjusted in tilt relative to said axis of rotation.

* * * * *